US006569288B1

(12) United States Patent
Linnonmaa et al.

(10) Patent No.: US 6,569,288 B1
(45) Date of Patent: May 27, 2003

(54) METHOD FOR MANUFACTURING SURFACE-TREATED PRINTING PAPER

(75) Inventors: Pekka Linnonmaa, Järvenpää (FI); Antti Heikkinen, Helsinki (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/743,556

(22) PCT Filed: Jul. 12, 1999

(86) PCT No.: PCT/FI99/00615

§ 371 (c)(1),
(2), (4) Date: Jan. 9, 2001

(87) PCT Pub. No.: WO00/03087

PCT Pub. Date: Jan. 20, 2000

(30) Foreign Application Priority Data

Jul. 10, 1998 (FI) ..... 981594
Nov. 27, 1998 (FI) ..... 982583

(51) Int. Cl.[7] ..... D21F 11/00

(52) U.S. Cl. ..... 162/207; 162/205; 162/135; 162/136; 162/198; 162/287; 162/265; 34/50; 34/54; 34/117; 34/118; 34/119; 100/74; 100/38; 100/153

(58) Field of Search ..... 162/135, 136, 162/198, 205, 207, 287, 265, 121; 34/50, 54, 117, 118, 119; 100/38, 74, 153

(56) References Cited

U.S. PATENT DOCUMENTS

| | | | | |
|---|---|---|---|---|
| 3,735,929 | A | 5/1973 | Pleines | 239/341 |
| 3,948,721 | A | 4/1976 | Winheim | 162/207 |
| 4,096,311 | A | 6/1978 | Pietreniak | 428/289 |
| 4,474,643 | A | 10/1984 | Linblad | 162/198 |
| 5,093,795 | A | 3/1992 | Lewis | 364/471 |
| 5,470,436 | A | 11/1995 | Wagle et al. | 162/207 |
| 5,483,873 | A | 1/1996 | Koivukunnas et al. | 100/38 |
| 5,557,860 | A | 9/1996 | Kotitschke et al. | 34/455 |

*Primary Examiner*—Steven P. Griffin
*Assistant Examiner*—Mark Halpern
(74) *Attorney, Agent, or Firm*—Steinberg & Raskin, P.C.

(57) ABSTRACT

In the method for manufacturing surface-treated printing paper, a paper web is first dried down to a target moisture of the surface treatment, and it is wetted again to the target moisture before the surface treatment. The rewetting to the target moisture is conducted on the web running to the surface treatment before a device effecting the surface treatment of the web, as seen in the travel direction of the web. Before re-wetting, the moisture profile of the web is adjusted in the drying section by wetting the web at a point which is located before the area of the heavy shrinkage (cd shrinkage area) in the travel direction of the web.

14 Claims, 5 Drawing Sheets

METHOD FOR MANUFACTURING SURFACE-TREATED PRINTING PAPER

FIELD OF THE INVENTION

The present invention relates to a method for manufacturing surface-treated printing paper, in which method the surface of the paper is treated after drying.

In accordance with such a method, paper with certain desired properties is produced in an advantageous manner.

The invention also relates to an apparatus for manufacturing surface-treated printing paper in which apparatus the paper is treated after drying.

BACKGROUND OF THE INVENTION

A papermaking method of prior art is the one in which finished calendered paper web is produced in separate processes. Thus, the web is first dried in the paper machine, typically down to the moisture of approximately 2 to 4%, i.e. it is overdried, whereafter the paper is wetted typically to the moisture of 8 to 12% before reeling up the web. Thereafter, when the paper is on the reel, the moisture has the time to equalize itself in the thickness direction of the paper before surface treatment in the calender, i.e. calendering. In this context, overdrying refers to the process of drying the paper into a moisture which is lower than the moisture allowed normally when the paper enters the calender nip, when it is taken into account that in the calendering the moisture of the web is reduced further by over 2 percentage points, wherein the paper attained after calendering is drier than the moisture of use of the paper in normal conditions.

Another papermaking method of prior art is the one in which in connection with the drying of paper, e.g. in the drying section, the web is wetted with the aim of correcting the moisture profile of the paper.

It has been suggested that the calendered paper could be manufactured in such a way that calendering is conducted in connection with the manufacturing process, wherein the web is dried directly down to a so-called calendering moisture, i.e. to a target moisture of calendering.

However, prior art entails considerable problems and drawbacks. Especially in the manufacturing processes of SC paper grades it is, in addition to the wetting of paper, important how moisture is controlled before wetting to the target moisture of calendering.

OBJECTS AND SUMMARY OF THE INVENTION

Thus, the purpose of the present invention is to eliminate the drawbacks of prior art and to attain an entirely new solution in which the papermaking process is effected in an optimal way.

The invention is primarily based on the idea that at the same time when a paper web is produced by means of a papermaking process, the paper web is first dried in a drying section or the like down to a determined first moisture content, whereafter the moisture content of the web is increased to a second treatment moisture content, whereafter the web is guided substantially immediately to the treatment of paper in which its surface properties are affected, after which the web is reeled on paper reels formed thereby.

Within the scope of the present invention, the moisture of the web refers to the ratio of its water content to the entire mass.

According to a first advantageous embodiment of the invention, the manufacture of paper is conducted as a continuous process in the following way. The formation and mechanical dewatering of paper is conducted in a preselected way. The web which is thereby formed is dried further so that the moisture content of the web is reduced in a desired way to a particular first moisture content, whereafter the moisture of the web is increased to a second, treatment moisture content of the web which, in other words, is higher than the first moisture content, whereafter the web is guided substantially immediately to paper treatment in which its surface properties are affected. Thereafter the paper is reeled in the reel-up to form a reel.

In this context, the substantially immediate guiding of the web refers to a wetting location by means of which a desired residence time from the wetting to the treatment of the paper is attained. Advantageously this is determined in such a way that the residence time from the wetting to the treatment will be 0.2 to 2.0 seconds. The lower limit is primarily determined by the fact that the aim is to ensure an even moisture distribution in the paper and the upper limit by the penetration of moisture in the paper. The machine construction is also a determining factor for the upper limit because the path travelled by the web from the wetting to the treatment becomes long.

Within the scope of this application, the act of affecting the surface properties advantageously involves calendering or production of a corresponding effect. After the paper has been dried, the surface structure of the web is made suitable by means of a mechanical treatment, calendering. There are several calendering methods, but it is common to all of them that the web is passed through one or several nips which are formed between two surfaces, typically between rotating roll surfaces. The purpose of the calendering is to improve the paper quality by pressing the paper into a fixed final thickness, and especially by smoothing its surface. As is well known, moisture improves the mouldability of fibres contained in paper in connection with calendering. Because of this, the calendering is conducted in a certain moisture content, "target moisture of the calendering".

Advantageously the increase of moisture from the first moisture content to the second moisture content before affecting the surface properties of paper, e.g. before calendering, is not higher than 10%, advantageously 2 to 10%, expressed as a difference between the moistures.

According to a second advantageous embodiment of the invention, the manufacture of paper is conducted in a continuous process in such a way that the formed web is dried in such a way that the moisture content of the web is reduced in a desired manner to a certain first moisture content, advantageously to a moisture of $\leqq 6\%$, typically, depending on the case, to a moisture of 2 to 6%, whereafter the moisture of the web is increased to a second, treatment moisture content of the web, which is preferably $\geqq 8\%$, most preferably 8 to 12%, i.e. it is higher than the first moisture content, whereafter the web is guided substantially immediately to paper treatment in which its surface properties are affected.

By means of the invention considerable advantages are achieved. First of all, the dimensional stability of the paper is improved when the fibres experience the first drying stage. This "overdrying" is well founded because the moisture expansion potential of the paper is reduced when the lowest moisture content experienced by the paper during the papermaking is reduced. This means that the behaviour of the web will be more stable for example in printing. On the other hand, drying to the first moisture content levels down possible moisture streaks in the paper. In the method according to the invention, it is especially important to level down small-scale (1 to 3 mm) streaks.

Another essential aspect in the process according to the invention is that the moisture profile of the paper web to be formed is sufficiently straight. Thus, a feature entailed in the solution according to the invention is a method for controlling the moisture profile in the papermaking process. Conventionally, a known procedure has been the use of a so-called profiling steam box in the press section and at a later stage a profiling water moistener as an actuator in the adjustment of the moisture profile. It has now been observed that with respect to the entire process, there is a certain stage in which it is not advantageous to utilize wetting. It has been detected that there is a stage in the drying of the web where the web shrinks strongly primarily in the cross machine direction, and it has been observed that the use of wetting in this area may have disadvantageous effects. Typically, the web shrinks strongly in the cross machine direction when in the dry matter content range of 65 to 85%. This area can vary e.g. according to the conditions of the process and the paper grade to be manufactured.

BRIEF DESCRIPTION OF THE DRAWINGS

In the following, the invention will be described in more detail with reference to the appended drawings, in which.

DETAILED DESCRIPTION OF THE PREFERRED EMBODIMENTS

Figure 1:
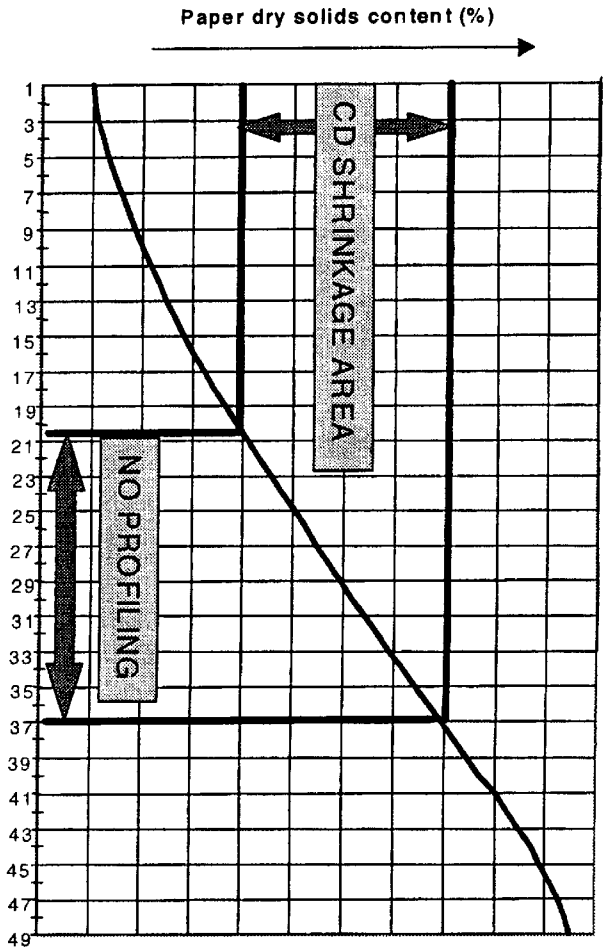
FIG. 1 shows schematically the development of the dry matter content of the paper.

In FIG. 1 it is possible to see how the dry matter content typically develops in evaporative drying in the paper machine, e.g. in a multi-cylinder dryer. In the figure, the numbering of x-axis corresponds to the number of drying cylinders. Drying cylinders refer to heated cylinders. The drying section may also contain unheated cylinders, such as vacuum rolls, which guide the web. The drawing shows a particular area (cd shrinkage area) in which the aforementioned shrinkage of the web occurs. On the basis of this observation it is possible to arrange the control of the moisture profile in accordance with the invention in the following way, as shown in FIG. 3.

Figure 2:
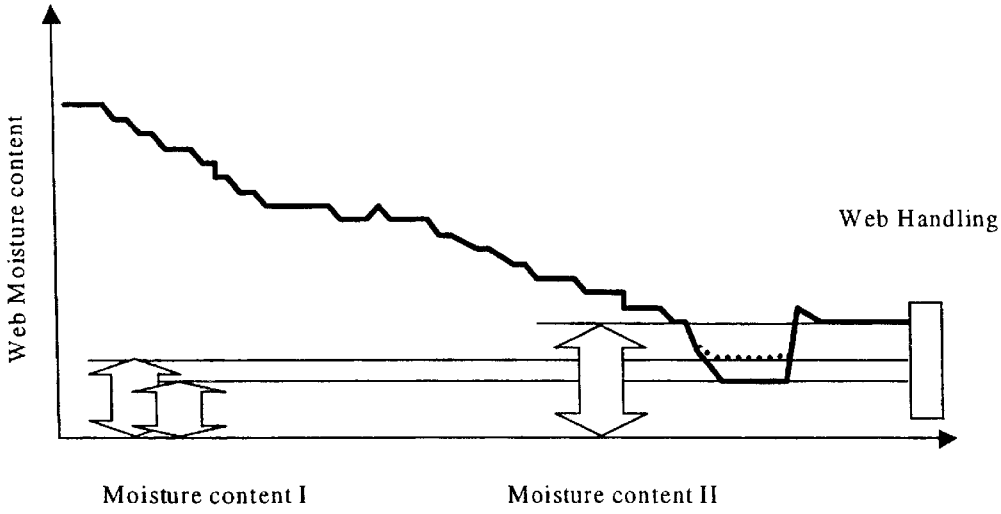
FIG. 2 shows schematically the development according to the invention in the moisture content of the web.

FIG. 2 shows the development in the moisture content of the web attained by means of the method according to the invention. Therein it can be seen how the formed web is dried in such a way that the moisture content of the web is reduced in a desired manner to a first moisture content (Moisture content I), whereafter the moisture of the web is increased to a second, treatment moisture content (Moisture content II), which is higher than the first moisture content, whereafter the web is guided substantially immediately to paper treatment in which its surface properties are affected. The broken line and the two arrows illustrate the possibility. to select the overdrying level of the web (moisture content I). The process of affecting the surface properties according to the invention involves multi-nip calendering or a corresponding process. As can be seen in the figure, the first moisture level can be selected suitable on the basis of the desired final result or some other reason. Typically, the first moisture level is 2 to 6%. Such a method primarily has two purposes. First of all, the dimensional stability of the paper is improved, when the fibres experience a drying stage in which the paper is dried down to the first moisture content. In practice this means that the behaviour of the web will be more stable for example in printing. On the other hand, such a procedure levels down the moisture streaks in the paper. In the method according to the invention, it is especially important to smooth small-scale (1 to 3 cm) streaks. In conventional moisture profiling devices the operating range is restricted to the scale of approximately 50 mm and larger than that.

Figure 3:
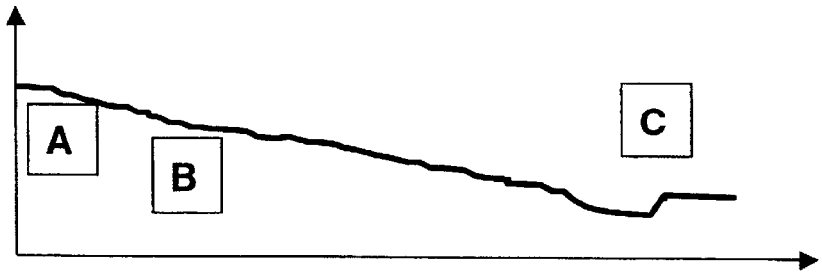
FIG. 3 shows schematically the method according to the invention for controlling the moisture profile.

According to FIG. 3, it is possible to provide the apparatus implementing the method advantageously with three actuator positions. Letter A describes the steam profiling occurring in the press section, letter B describes water profiling occurring in the initial drying section and letter C describes the increasing of the moisture content in the end of the drying section.

The process principle according to an embodiment of the method according to the invention functions in such a way that paper is dried so much or to such a high dry matter content for which the drying capacity in the drying section is sufficient. In practice, this means a moisture level of 4 to 6%, typically 5 to 6%, i.e. a slight overdrying in which the paper is, however, clearly on a moisture level lower than the target moisture of calendering. The paper is re-wetted with a secondary moistener which is in the position C. This device can be for example a moistener of two or four nozzle rows with a spacing of 50 mm between the nozzles, and extending in the cross-machine direction of the web. It is advantageously mounted above the paper, because in this way the natural twosidedness of the paper is best taken into account. The moistener may also be located on both sides of the web to attain a two-sided wetting.

The moisture profiling of the paper is thus implemented in the positions A and B of FIG. 3. The aim is to make the moisture profile of the paper as straight as possible before the beginning of the shrinkage. The position A advantageously contains a profiling steam box of the press section. By acting in this way a higher dry matter content of the paper as well as a good profile control are achieved.

Point B contains water profiling of paper. For this a water moistener is advantageously used. The aim of the profiling occurring at points A and B is that the moisture profile is as even as possible before the beginning of a cross direction shrinkage (CD shrinkage). According to the invention, it is possible to provide the system also with a moisture profile measurement immediately after point B, wherein the control of the steam box and the water profiler would take place on the basis of the signal measured therefrom. When necessary, this can also be conducted by means of a measuring device arranged before the calender and/or the reel-up.

In a more definite positioning of the profiling wetting device of point B inside a multi-cylinder drying section, it is possible to utilize the dry matter content of the web as a function of the running number of the drying cylinders in the drying section. The profiling wetting device can be placed in a location which in the travel direction of the web is situated before the 25th drying cylinder of the drying section, advantageously before the 21st drying cylinder of the drying section. Most likely the wetting takes place before the beginning of the cross directional shrinkage, if the profiling wetting device is located before the 19th drying cylinder of the drying section. The profiling wetting device can be located before the 18th drying cylinder, before the 17th drying cylinder, before the 16th drying cylinder or before the 15th drying cylinder. It may be located immediately before the drying cylinder defined above by the running number, or further before the above-defined drying cylinder, wherein there may be one or more drying cylinders between the wetting device and the defined cylinder. The wetting device is located inside the drying section, after one or more drying cylinders, wherein the web is already dry as a result of the effect of the drying cylinders.

In the point C there is a re-moistener, by means of which the moisture level of paper is primarily increased from the overdried state to the state required by calendering, i.e. to the target moisture of calendering. The location of the moistener is, according to the principles presented hereinbelow, selected in such a way that a suitable absorption time of water before the first nip of the calender is ensured. The moistener is advantageously placed above the paper which is considerably rougher than the lower side. Thus, the final two-sidedness of the roughness in the paper is minimized. Wetting can also be implemented on both sides.

Figure 4:
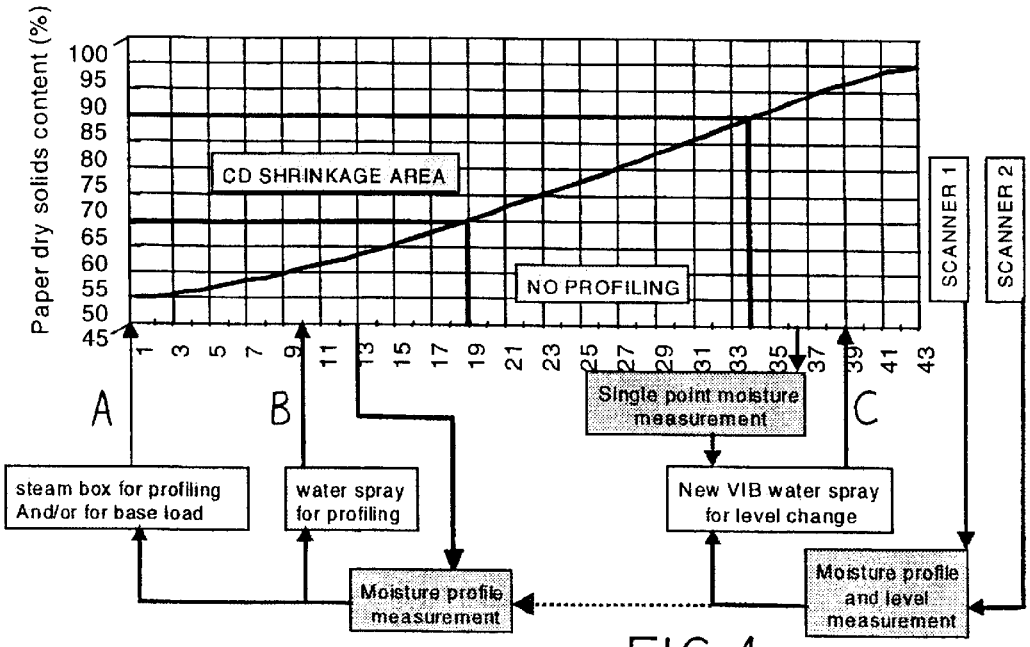
FIG. 4 shows schematically the control principle of the process according to the invention.

FIG. 4 shows an advantageous profile controlling procedure of the method according to the invention. In the figure, the number of drying cylinders in the drying section is shown on axis x and the dry matter content on axis y. The apparatus advantageously comprises two measuring devices, which are measuring beams (scanner) with a traversing measuring sensor. The first measuring device (scanner 1) is located before the on-line calender after the drying section and the second one (scanner 2) before the reel-up after the calender. The control method can be implemented in the following way: the adjustment of CD moisture profile by means of a steam box and/or wetting by water before the shrinkage stage (CD shrinkage area) is thus based on the moisture measurement of the first measuring device (scanner 1). The adjustment is advantageously a compromise adjustment of a particular degree in which part, e.g. 70%, of the possible inaccuracies in the moisture profile are corrected by means of the steam box of point A and the water profiler of point B, and the rest, e.g. 30% of them with the re-moistener of point C. The final moisture adjustment is implemented on the basis of the latter moisture measurement (scanner 2) and by controlling the level of the re-moistener of point C.

A solution which is more advantageous than the above-presented one, will be described in the following. After the water profiler located at point B, before the shrinkage area (in this example on the cylinder 10), a measurement of moisture profile is arranged, which controls both the steam box in the press section of point A, and the water profiler of point B. The measurement is advantageously a one-sided reflective IR moisture meter. Naturally, the aim is to attain a straight moisture profile. Before the re-moistener of point C (in this example located on cylinder 39), there is advantageously a spot moisture measurement (e.g. a reflective IR meter). By means of this the average moisture level is measured before the re-moistener of point C. The actual feedback control is obtained by the re-moistener both from the moisture measurement (scanner 1) that is before the calender and from the moisture measurement (scanner 2) that is before the reel-up. The measurement before the calender is advantageously used for fine adjustment of the profile and the measurement before the reel-up is used for adjustment of the correct final moisture level.

Figure 5:
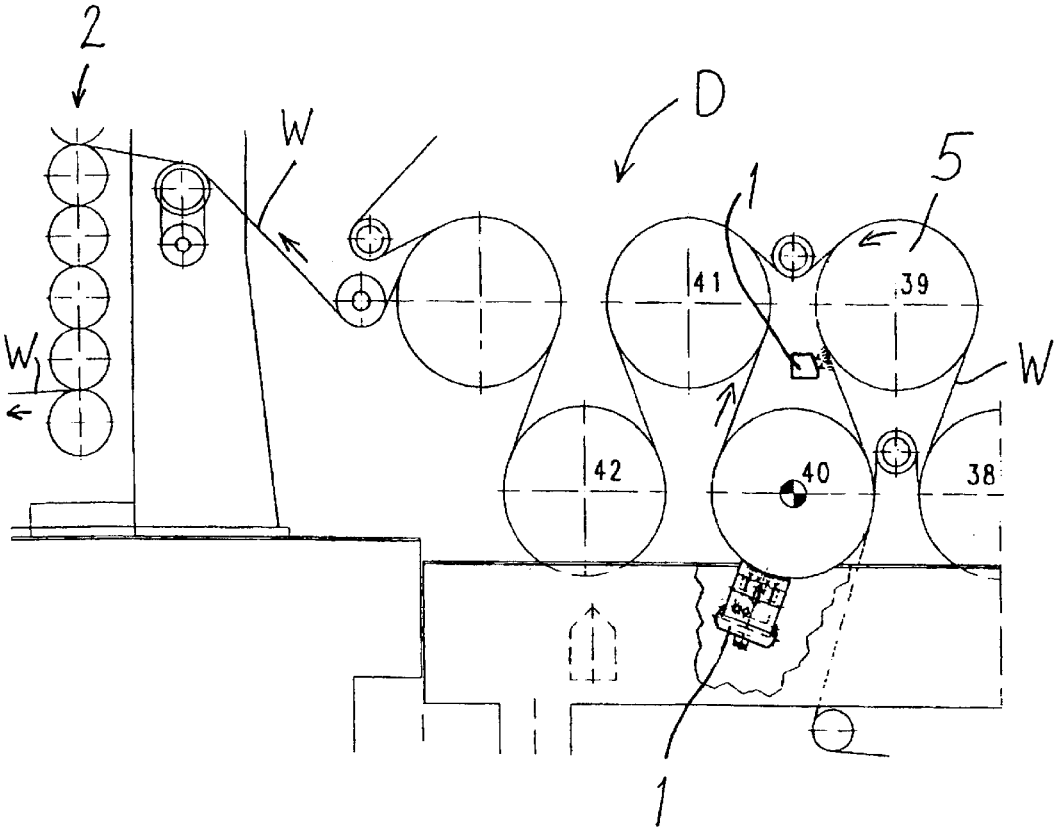
FIG. 5 shows an example of the placement of a re-wetting point.

It was mentioned above that the re-moistener is in the end of the drying section. It can thus be inside the last drying cylinder group in such a way that web does not become considerably dryer than the moisture level obtained in the re-wetting. Thus, the re-moistener can also be placed on both sides of the web. Especially in machine rebuilds in which the distance between the drying section and the calender cannot be increased, or it is not possible to place auxiliary devices between them, a sufficiently long distance between the wetting point and the first calender nip is attained as a result of the meandering travel path caused by the last drying cylinders in the drying section. FIG. 5 shows an example of the placement of the devices implementing the re-wetting of point C in the last drying cylinder group of the drying section D. The upper side of the paper is wetted by means of a wetting device 1 spraying the moistening water in an area where the web W has been detached from the mantle of a drying cylinder 5 (in this case the cylinder 39). The bottom-side wetting is implemented by means of the wetting device 1 on the web W traveling on the mantle of the next drying cylinder 5 (cylinder 40). After the wetting the web still travels along a winding or meandering path guided by the last cylinders in the cylinder group, and thereafter the web is guided to the calender 2.

Two-sided re-wetting is advantageous especially in the case where the paper is overdried down to a moisture of under 4%, e.g to the level of 2 to 4%.

Figure 6:
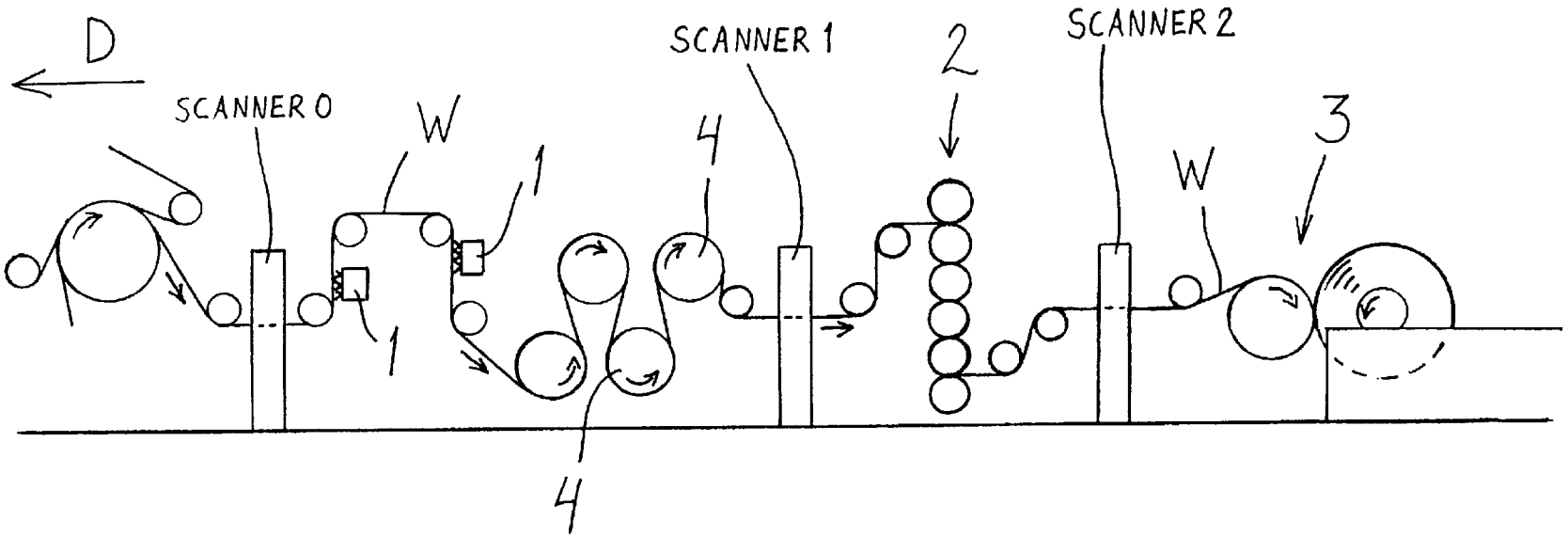
FIG. 6 shows an advantageous arrangement according to the invention for increasing the final moisture level and conducting the calendering.

FIG. 6 shows an advantageous apparatus for implementing the method according to the invention. In the apparatus the web W coming from the drying section D is passed through a first measuring device (scanner 0) measuring the moisture profile, whereafter the moisture level of the web is increased. Here, two wetting devices 1 are shown, which wet each their own side of the paper, but in certain cases it is possible to use e.g. only one wetting device which is arranged on the desired side of the paper. This is influenced e.g. by the moisture level of the web and the desired final properties of the paper. The wetting device is arranged sufficiently far before the calender 2 in the travel direction of the web, so that the water has the time to be absorbed in the surface layer of the web. To attain a suitable distance without increasing the machine length, the web W is passed between the wetting devices 1 and the calender 2, along a winding or meandering travel path which is produced e.g. by means of guiding rolls 4 which have been placed at different heights with respect to each other, for example in rows at two different heights. The wetting device is advantageously a water moistener which meters a suitable amount of moistening water on the surface of the web. The moistener is for example a roll moistener or a spray moistener or any other moistener by means of which water is introduced on the surface of the paper, and the water can also be in the form of steam or a mixture of steam and liquid water. In this context the moistening water refers to all aqueous substances, either pure water or water containing substances dissolved or suspended therein. The calender 2 is a multi-nip calender in which successive nips are formed between rolls superimposed in the stack of calender rolls. The structure of the calender can be any of those used in on-line multi-nip calenders. Advantageously, it contains over 4 nips, and FIG. 1 shows a calender with 5 nips and 6 rolls. It is also possible to use a calender with 8, 10 or 12 rolls and with 7, 9 or 11 nips, respectively. In a known manner the calender contains rolls with metal or polymer surface. After the calender 2 the paper web W is reeled in a reel-up 3 to form a machine reel. The moisture after the wetting, i.e. the moisture level and profile of the web entering the calender, can be measured with a measuring device (scanner 1) measuring the moisture profile, which device is located immediately before the calender 2, in FIG. 6 between the guide rolls 4 and the calender 2. The moisture profile and moisture level of the web after the calendering is measured further with a third measuring device (scanner 2) measuring the moisture profile. The wetting devices 1 can be controlled through a feedback loop by means of the measuring devices (scanner 1, scanner 2) located before the calender 2 and before the reel-up 3.

The placement of the wetting device/s 1 in the position C to attain a sufficient residence time, is determined in accordance with the absorption time required by the water. In this context, the absorption time refers to the time after which an optimal calendering result is achieved after applying water on the paper. The absorption time is 0.2 to 2.0 s. In relation to the web speeds used for printing papers, such as e.g. SC papers, the location point of the wetting device 1 is typically 5 to 40 m, advantageously 5 to 35 m before the calender when measured along the path travelled by the web.

Figure 7:
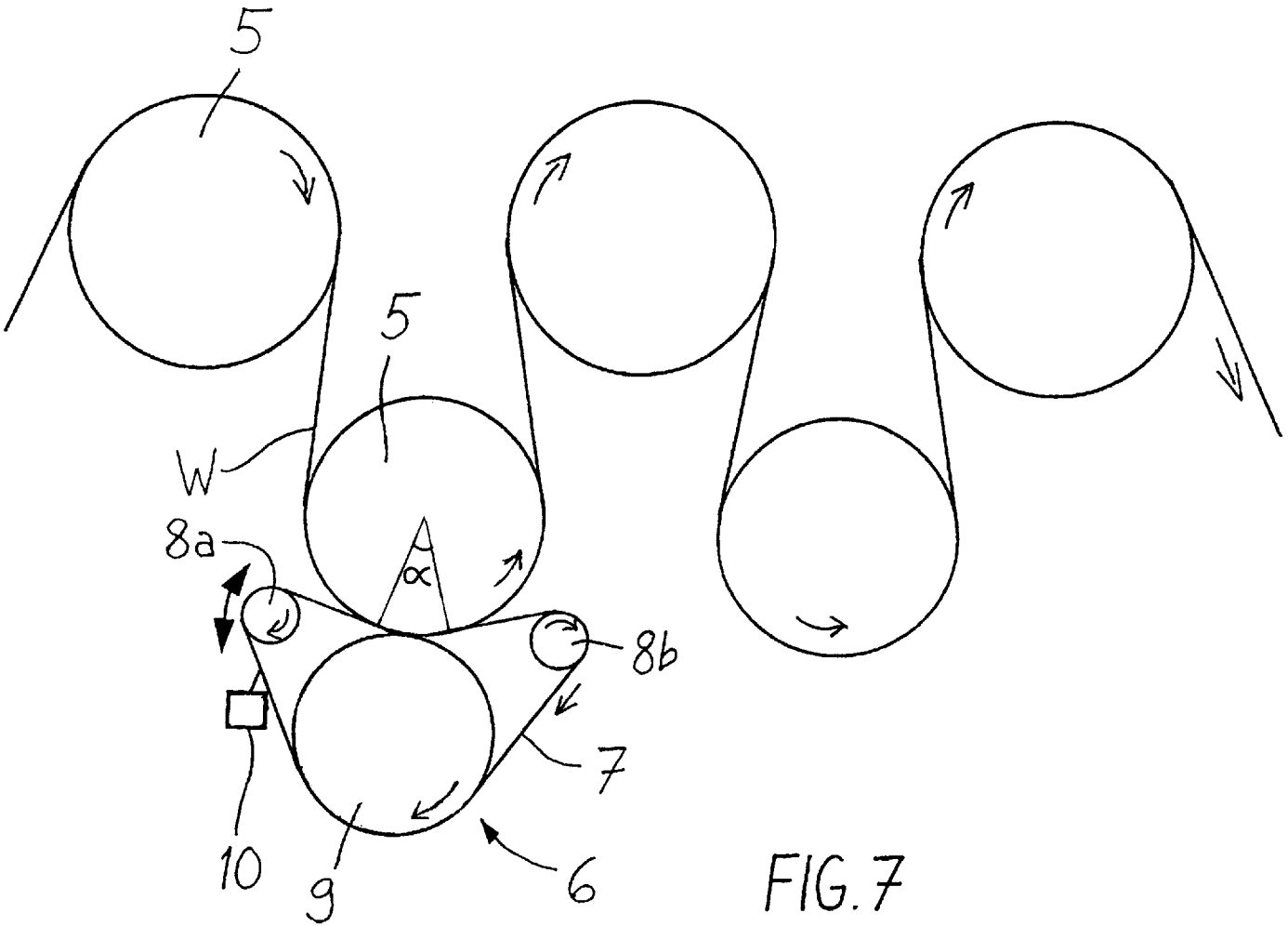
FIG. 7 shows a possible wetting device in the drying section.

FIG. 7 shows a way of conducting profiling in point B inside the drying section before the beginning of a cross directional shrinkage area. A continuous supporting member, such as a drying wire, which supports the paper web W when it travels between the upper and lower cylinders 5 of the cylinder group, is not shown. To the lower cylinder 5 of the drying cylinder group, by which the supporting member is between the web W and the mantle of the cylinder 5, a belt-roll combination 6 is connected, in which a loop formed by an endless belt 7 is guided by means of a guide roll 8*a* in contact with the web W traveling topmost on the cylinder 5. At the same time the belt 7 is brought in contact with the centre roll 9 of the loop, around which centre roll 9 the belt loop travels and by means of which it is also possible to influence the pressure of the belt 7 against the web W. The belt 7 is in contact with the web within a certain portion in sector $\alpha$, wherafter it moves to a second guide roll 8*b* which guides the belt 7 to a return section around the centre roll 9. The winding sector of the belt 7 around the cylinder 5 can be adjusted by moving either guide roll 8*a*, 8*b*, or both guide rolls 8*a*, 8*b*. By moving the guide rolls it is also possible to adjust the tension of the belt 7. Water is metered on the belt by means of a profiling metering device 10 before the belt 7 is brought in connection with the paper web, for example in the area between the centre roll 9 and the first guide roll 8*a* guiding the belt onto the cylinder 5. The profiling metering device 10 can be a suitable device capable of applying predetermined quantities of water in transverse zones on the surface of the belt. Thus, for the metering of water it is possible to use a spray beam or trailing blade or metering bar principles. As a result of the good contact between the belt 7 and the web W (e.g. a long shared path on the periphery of the cylinder 5 in the winding sector $\alpha$), the wetting takes place evenly in a forced contact with the web. The surface of the web must have such a quality that it is receptive for water, wherein it can be equipped with a suitable coating. However, the belt has to be capable of delivering the water applied thereon to the paper web W.

In addition to the profiling wetting, the belt 7 produces a pre-calendering effect on the web. The surface of the web is at this stage so wet that the calendering effect of the belt is effective even with a small pressure. Thus, the belt 7 moulds the surface of the web W smoother only in a small scale and the thickness of the web is not substantially changed. With the tension of the belt and the pressure generated by means of the centre roll 9, the water can be made to penetrate into the structure of the paper to level the moisture profile. The loading of the centre roll 9 is not necessary, but it is possible to utilize only the tension of the belt.

By means of the present method it is possible to advantageously produce a so-called gradient paper in which the bulky quality in the centre part of the paper has been retained in the calendering by utilizing the method according to the invention. It is typical for the calendering process after the wetting in point C that the process is a gradient calendering process. The gradient is attained in the paper by drying it down to a moisture of 2 to 4% and by re-wetting it to the target moisture of 8 to 12% (total moisture). It is typical for the wetting that it is conducted immediately before the calender 2, unlike before, when re-wetting was conducted before reel-up. The placement of wetting device/s is determined on the basis of the absorption time required by the water, as described above.

It is typical for the wetting device 1 that it produces a sufficiently even film or a layer of water on the surface of the paper. A known fact in connection with a spray-moistener is that the average droplet size has to be in the correct. proportion with the water amount to be sprayed. Typically, when the water amount is 0.1 to 10 g/m$^2$, it is advantageous to use the average droplet size of 10 to 100$\mu$.

The effect of the moisture gradient on the quality of the paper depends substantially on the steepness of the gradient. When the central parts of the paper are dry, they behave more elastically in the pressing than wet surfaces. Thus, most of the effect of the calender that moulds the paper is restricted to wet surfaces. The central part is restored elastically almost to its original state after the pressing. Thus, the surfaces are relatively more condensed in the calendering than the centre of the paper.

The present invention has been described herein with reference to preferred embodiments of the invention however the description provided herein is for illustrative purposes and should not be considered to be exhaustive. It is understood that modifications and variations of the above describe preferred embodiments are possible without departing from the spirit or scope of the present invention.

What is claimed is:

1. A method for manufacturing a surface-treated printing paper from a paper web in a paper machine, comprising the steps of:

drying said paper web down to a predetermined first moisture content in a drying device, said predetermined first moisture content being not higher than 6% by weight;

re-wetting (point C) said paper web to a second treatment moisture content prior to said paper web entering a surface treatment device (2) in a web running direction, said second treatment moisture content being not lower than 8% by weight; and guiding said paper web from said drying device to said surface treatment device (2).

2. The method according to claim 1, wherein said re-wetting of said paper web occurs as said paper web travels from a drying section (D) of said paper machine to said surface treatment device (2).

3. The method according to claim 2, wherein said re-wetting of said paper web occurs within said drying section (D), wherein said re-wetting occurs in a last drying cylinder group of said drying section (D).

4. The method according to claim 2, wherein said re-wetting of said paper web occurs after said paper web exits said drying section (D).

5. The method according to claim 2, further comprising the step of:

adjusting a moisture profile of said paper web while said paper web is in said drying section (D) by re-wetting said paper web while in said drying section prior to a web cross direction shrinkage area in said drying section.

6. The method according to claim 5, wherein said adjusting of said moisture profile of said paper web by re-wetting occurs before said paper web reaches a dry matter content of 65% by weight in said drying section.

7. The method according to claim 5, wherein said adjusting of said moisture profile of said paper web by re-wetting occurs before said paper web reaches a twenty-first drying cylinder of said drying section.

8. The method according to claim 7, wherein said adjusting of said moisture profile of said paper web by re-wetting occurs before said paper web reaches a fifteenth to a nineteenth drying cylinder of said drying section.

9. The method according to claim 5, further comprising the steps of:

measuring said moisture profile of said paper web after said re-wetting of said paper web in said drying section; and adjusting said re-wetting of said paper web based on the results obtained from said measuring of said moisture profile after said re-wetting of said paper web in said drying section.

10. The method according to claim 5, comprising the step of:

applying water to said paper web in a profiled manner by means of a belt which is in contact with said paper web.

11. The method according to claim 1, comprising the step of:

applying a moistening water onto said paper web between about 0.2 and 2 seconds before said paper web arrives at said surface treatment device (2).

12. The method according to claim 1, wherein said surface treatment device is a multi-nip calender.

13. The method according to claim 1, wherein said first moisture content is 2% to 6% by weight and said second treatment moisture content is 8% to 12% by weight.

14. The method according to claim 13, wherein said first moisture content is 2% to 4% by weight.

* * * * *